US008346069B2

(12) United States Patent
Yeung

(10) Patent No.: US 8,346,069 B2
(45) Date of Patent: Jan. 1, 2013

(54) WATER HEATING APPARATUS

(75) Inventor: Wing Yiu Yeung, Hong Kong (HK)

(73) Assignee: Advanced Materials Enterprises Company Limited, Hong Kong (HK)

( * ) Notice: Subject to any disclaimer, the term of this patent is extended or adjusted under 35 U.S.C. 154(b) by 608 days.

(21) Appl. No.: 12/489,465

(22) Filed: Jun. 23, 2009

(65) Prior Publication Data

US 2009/0317068 A1 Dec. 24, 2009

Related U.S. Application Data

(60) Provisional application No. 61/075,008, filed on Jun. 24, 2008.

(51) Int. Cl.
*F24H 1/10* (2006.01)
*H05B 3/78* (2006.01)

(52) U.S. Cl. ..... 392/491; 392/465; 392/492; 392/493; 392/494

(58) Field of Classification Search ..... 392/491, 392/492, 493, 494
See application file for complete search history.

(56) References Cited

U.S. PATENT DOCUMENTS

| | | | | | |
|---|---|---|---|---|---|
| 830,248 | A * | 9/1906 | Von Orth | 165/154 |
| 950,599 | A * | 3/1910 | McGerry | 392/350 |
| 1,376,509 | A * | 5/1921 | Borst, Jr. | 392/401 |
| 1,385,564 | A * | 7/1921 | Luehrs | 392/491 |
| 1,396,121 | A * | 11/1921 | Jacobsen | 392/462 |
| 1,850,156 | A * | 3/1932 | Richardson | 392/492 |
| 1,985,830 | A * | 12/1934 | Powers | 392/492 |
| 2,825,791 | A * | 3/1958 | Jackson | 237/8 R |
| 4,410,791 | A * | 10/1983 | Eastep | 392/493 |
| 5,438,642 | A * | 8/1995 | Posen | 392/485 |
| 5,787,229 | A * | 7/1998 | Liljegren | 392/492 |
| 2008/0190912 | A1 * | 8/2008 | Yeung et al. | 219/443.1 |
| 2010/0092163 | A1 * | 4/2010 | Yeung | 392/441 |

* cited by examiner

*Primary Examiner* — Thor Campbell

(57) ABSTRACT

A water heating apparatus includes a water tank and at least one heating member mounted inside the water tank. The heating member includes a heating body, at least a multi-layer conductive coating of nano-thickness deposited on the heating body, and electrodes coupled to the multi-layer conductive coating. The multi-layer conductive coating includes a structure and composition which stabilize performance of the heating member at high temperature. The heating body can be made of ceramic glass in the form of a flat plate.

12 Claims, 12 Drawing Sheets

WATER HEATING APPARATUS

RELEVANT PATENT APPLICATION

The present patent application claims benefit of U.S. Patent Provisional Application No. 61/075,008, filed on Jun. 24, 2008; the entirety of which is incorporated herein by reference.

FIELD OF PATENT APPLICATION

The present patent application relates to a water heating apparatus.

BACKGROUND

An integrated coating system has been disclosed in U.S. patent application Ser. No. 12/026,724, which is incorporated herein by reference to the extent necessary to understand and/or practice the water heating apparatus claimed in the present patent application. This integrated coating system is developed to produce reliable high temperature heating elements capable of performing reliable and consistent heating functions up to about 600° C. The coating system is deposited on a flat ceramic glass substrate and includes multi-layers of conductive coatings of nano-thickness of proprietary base chemistry, doped elements and process conditions, with capacity to maintain stable structure and performance at high temperature heating. The coating system further includes specially formulated ceramic frit parallel electrodes formed across the coatings to ensure optimum matching between the electrodes and the coatings and the substrate in reducing electric resistance and improving conductivity across the heating element. The coating system can be manufactured using spray pyrolysis at controlled temperature between about 650° C.-about 750° C. and controlled spray movement in formation of multi-layered nano-thickness films of about 50 nm-about 70 nm leading to increased stability at high temperatures.

A conductive coating material is used to convert electric power into heat energy. The heat generation principle as used is very different from conventional coil heating in which heating outputs come from the resistance of the metal coils with low heating efficiency and high power loss. In contrast, by adjusting the composition and thickness of the layers of coating, electric resistance of the coating system can be controlled and conductivity can be increased to generate high efficiency heating with minimal energy loss. An integrated coating system has been developed to produce reliable high temperature heating elements capable of performing reliable and consistent heating functions up to about 600° C. An intelligent power monitor and control system using analog-to-digital converter (ADC) and pulse-width modulation (PWM) drives integrated with the heating films can be provided in smoothing the power supply to the heating elements and optimizing their heating performance and energy saving efficiency in accordance with the required water temperature and flow rate.

The above description of the background is provided to aid in understanding a water heating apparatus, but is not admitted to describe or constitute pertinent prior art to the water heating apparatus disclosed in the present application, or consider any cited documents as material to the patentability of the claims of the present application.

SUMMARY

A water heating apparatus includes a water tank and at least one heating member mounted inside the water tank. The heating member includes a heating body, at least a multi-layer conductive coating of nano-thickness deposited on the heating body, and electrodes coupled to the multi-layer conductive coating. The multi-layer conductive coating includes a structure and composition which stabilize performance of the heating member at high temperature.

The water heating apparatus may include one heating member forming an n-shaped water path in the water tank.

The water heating apparatus may include a plurality of heating members arranged parallel to one another forming a winding water path in the water tank.

The water heating apparatus may include a plurality of heating members arranged horizontally and vertically forming a winding water path in the water tank.

The water heating apparatus may include a plurality of heating members electrically connected to one another in series.

The water heating apparatus may include a plurality of heating members electrically connected to one another in parallel.

The heating body of the heating member may be in the form of a flat plate.

The heating body of the heating member may be made of ceramic glass.

The electrodes of the heating member may be ceramic frit.

The heating member may include a plurality of conductive coatings electrically connected to one another in series.

The heating member may include a plurality of conductive coatings electrically connected to one another in parallel.

The water heating apparatus may include an insulation material covering the multi-layer conductive coating.

The water heating apparatus may include a power monitor and control system having analog-to-digital converter and pulse-width modulation drives.

The heating member may be removably mounted inside the water tank.

BRIEF DESCRIPTION OF THE DRAWINGS

Specific embodiments of the water heating apparatus disclosed in the present application will now be described by way of example with reference to the accompanying drawings wherein.

DETAILED DESCRIPTION

Reference will now be made in detail to a preferred embodiment of the water heating apparatus disclosed in the present application, examples of which are also provided in the following description. Exemplary embodiments of the water heating apparatus disclosed in the present application are described in detail, although it will be apparent to those skilled in the relevant art that some features that are not particularly important to an understanding of the water heating apparatus may not be shown for the sake of clarity.

Furthermore, it should be understood that the water heating apparatus disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the appended claims.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

Figure 1:
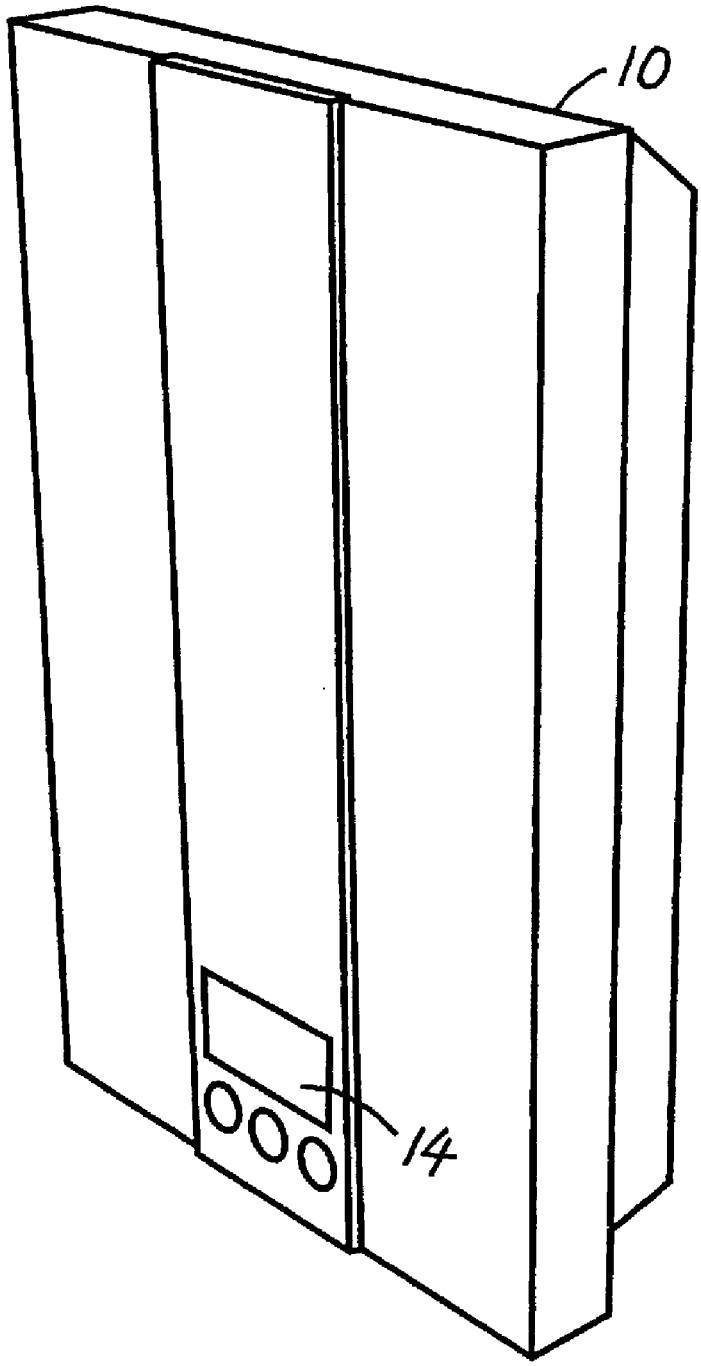
FIG. 1 is a front perspective view of a water heating apparatus according to an embodiment disclosed in the present application.
Figure 2:
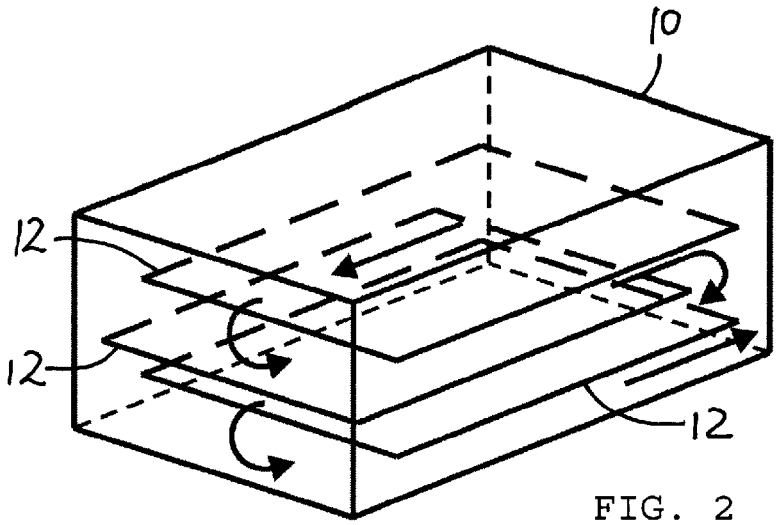
FIG. 2 is an illustrative diagram of a water heating apparatus with a number of heating members according to an embodiment disclosed in the present application.

FIG. 1 is a perspective view of a water heating apparatus 10 according to an embodiment of the present patent application. FIG. 2 is an illustrative diagram of a water heating apparatus with a number of heating members according to an embodiment disclosed in the present application As illustrated in FIGS. 1 and 2, the water heating apparatus 10 includes at least one heating member 12 including a heating body made of ceramic glass or other suitable materials, and a power and temperature monitor and control system 14 to control and optimize the water temperature and heating performance of the apparatus. A remote control using infra-red or other means may be added and integrated with the monitor and control system 14 of the water heating apparatus 10 to perform its design functions. According to the illustrated embodiment, the heating bodies of the heating members 12 are in the form of flat plates that can maximize the heating area for efficient heating of water inside the water heating apparatus 10 and achieve a slim and compact design.

The heating body of the heating member 12 of this application contains a flat surface to maximize the heating area for efficient heating of water inside the water heating apparatus 10 and to achieve a slim and compact design of the apparatus. For example, a 4 mm thick ceramic glass heating body of a size of 10×10 $cm^2$ may provide a heating surface up to 200 $cm^2$, with direct contact water heating on the two sides of the ceramic glass. In comparison, to provide the same heating surface, a tubular heating element may require a diameter of 6.4 cm, which will restrict a slim design that the hot water apparatus can achieve.

Instead of using the conventional metallic heating elements, the heating body of the heating member 12 is made of ceramic glass with multi-layered nano-thickness heating films applied on the surface. The ceramic glass is hard and strong with high temperature resistant. The ceramic glass can perform reliable and consistent heating functions up to about 600° C., and the heating members of this application can reach 300° C. in a minute and can provide very fast instant heating when the water flows over the glass surface. The ceramic glass is also non-corrosive and can be easily cleaned by running mild acid solution through the heating system. The heating members 12 can therefore last for long service life with easy maintenance.

Each heating member 12 can produce high power rating up to 5000 W (at 220V a.c.) in a small area of 10×10 $cm^2$. With a power density of 50 $W/cm^2$, a compact and slim-sized water heating apparatus 10 can be built with high power capacity that cannot be achieved by other conventional heating elements.

Figure 3:
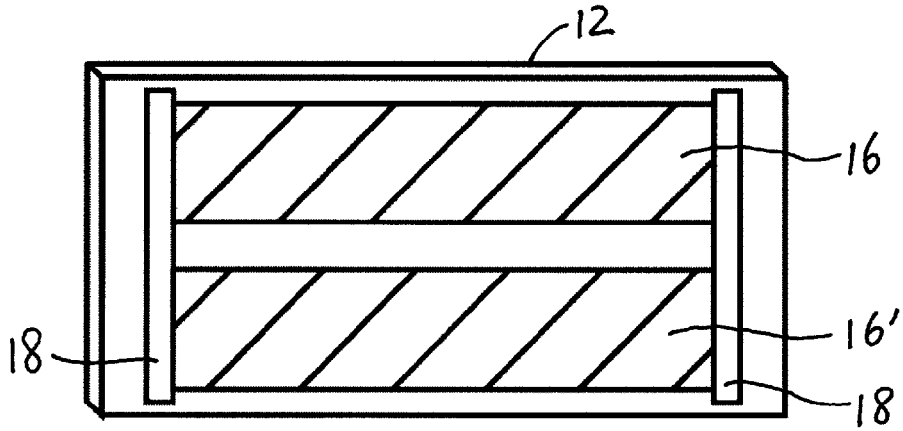
FIG. 3 is a front perspective view of a heating member with conductive coatings.
Figure 4:
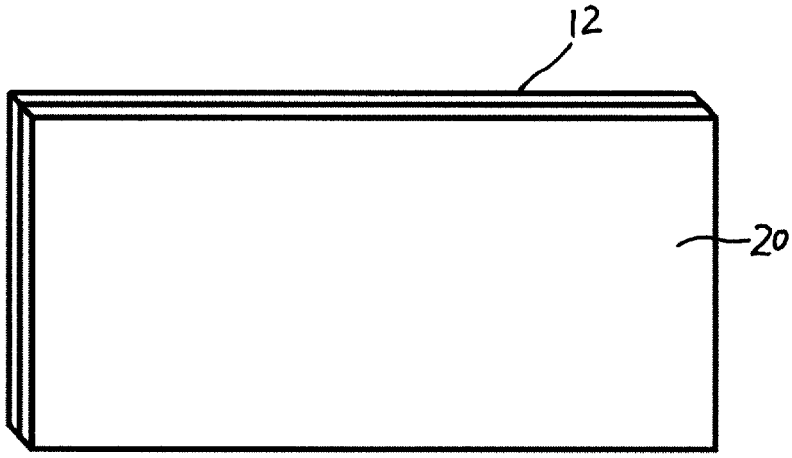
FIG. 4 is a front perspective view of the heating member of FIG. 3 being covered.

FIG. 3 is a front perspective view of a heating member 12 having a heating body made of ceramic glass. As shown in FIG. 3, multi-layered conductive coatings 16, 16' of nano-thickness of proprietary base chemistry, doped elements and process conditions, with capacity to maintain stable structure and performance at high temperature heating, and specially formulated ceramic frit electrodes 18 across the coatings are deposited on the ceramic glass heating body of heating member 12. The coating area can be covered by another ceramic glass 20 or other suitable materials for protection and insulation, as illustrated in FIG. 4. The heating member 12 is sealed and water-proof and is capable of direct contact with water.

Referring back to FIG. 3, each heating member 12 may include one or more conductive coatings 16, 16'. Each conductive coating 16, 16' includes a coating area of heating film. If the heating member 12 includes a plurality of conductive coatings 16, 16', the conductive coatings 16, 16' may have the same size or different sizes. The conductive coatings 16, 16' may have the same coating characteristics (e.g., structure, composition, thickness, etc.) or different coating characteristics. The conductive coatings 16, 16' can be electrically connected one another in parallel or in series. With proprietary characteristics of the conductive coatings 16, 16' and the electrical connection between the conductive coatings 16, 16', improvement of conductivity and reduction of electric resistance of the conductive coatings 16, 16' to below 10 ohms can be achieved, which is capable for generating high power output over a large heating area or high power density (>10 $W/cm^2$) over a small area for efficient water heating in electric kettles, domestic and industrial hot water heaters, and other water heating apparatus.

Figure 5:
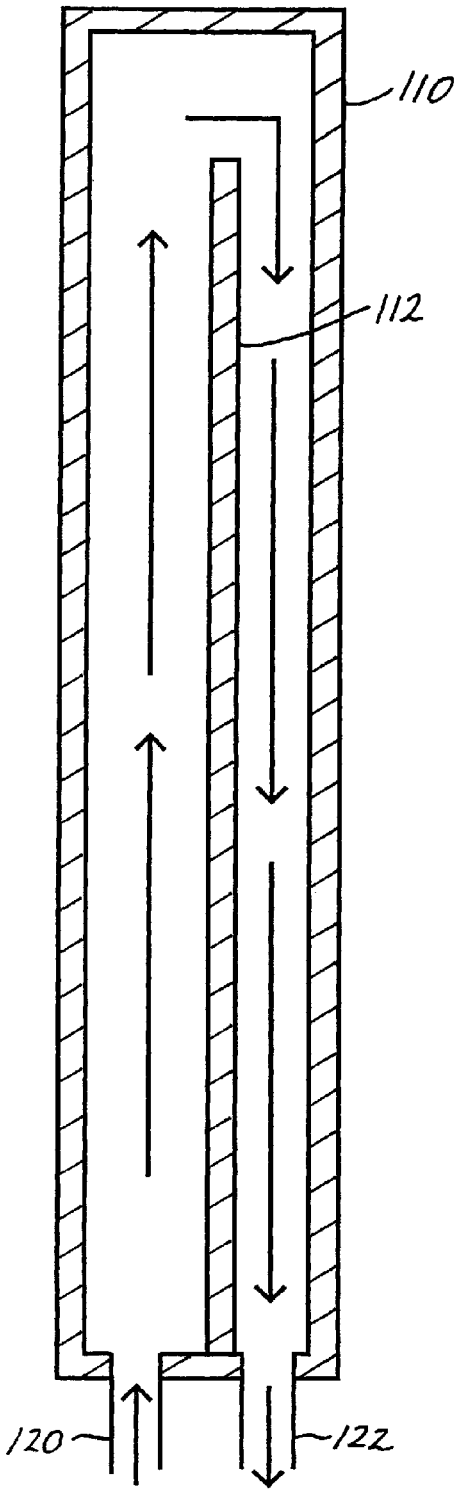
FIG. 5 is a cross sectional view of a water heating apparatus having a single heating member.

FIGS. 5-9 show several embodiments of the heating members of the water heating apparatus. FIG. 5 is a water heating apparatus 110 containing only one heating member 112 forming an n-shaped water path. The heating apparatus 110 has a water inlet 120 and a water outlet 122. Cold water enters the heating apparatus 110 through the water inlet 120. The cold water is heated by the heating member 112 as it moves along the path indicated by the arrows. Heated water exits the heating apparatus 110 through the water outlet 122.

Figure 6:
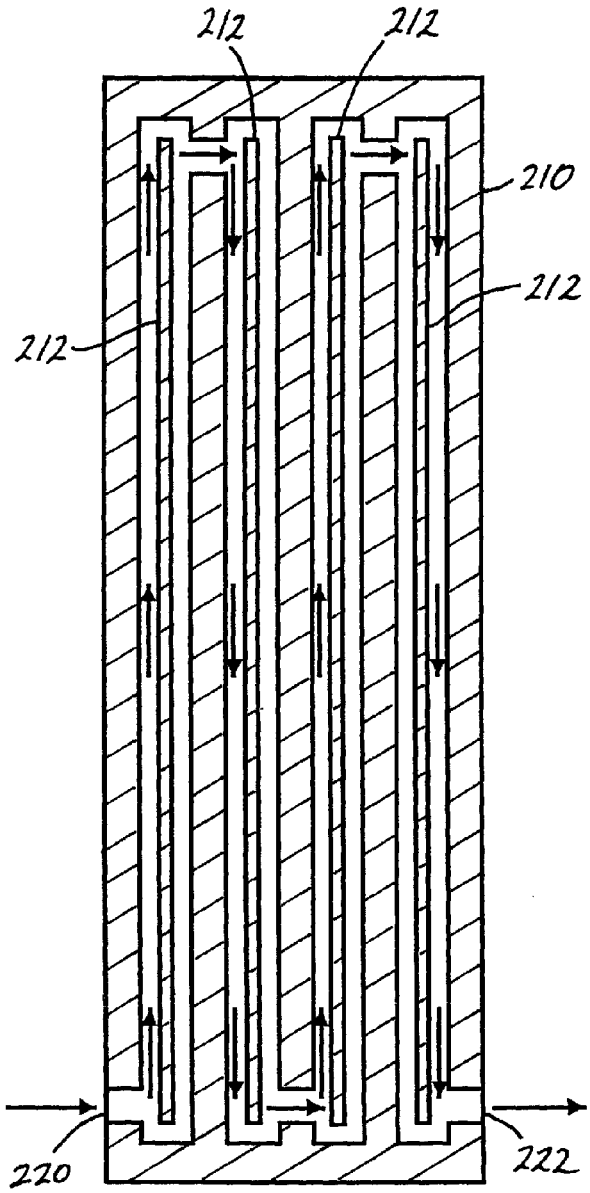
FIG. 6 is a cross sectional view of a water heating apparatus having four parallel heating members.

FIG. 6 shows a water heating apparatus 210 containing four heating members 212 forming a winding water path. Cold water enters the heating apparatus 210 through the water inlet 220. The cold water is heated by the four heating members 212 as it moves along the path indicated by the arrows. Heated water exits the heating apparatus 210 through the water outlet 222.

Figure 7:
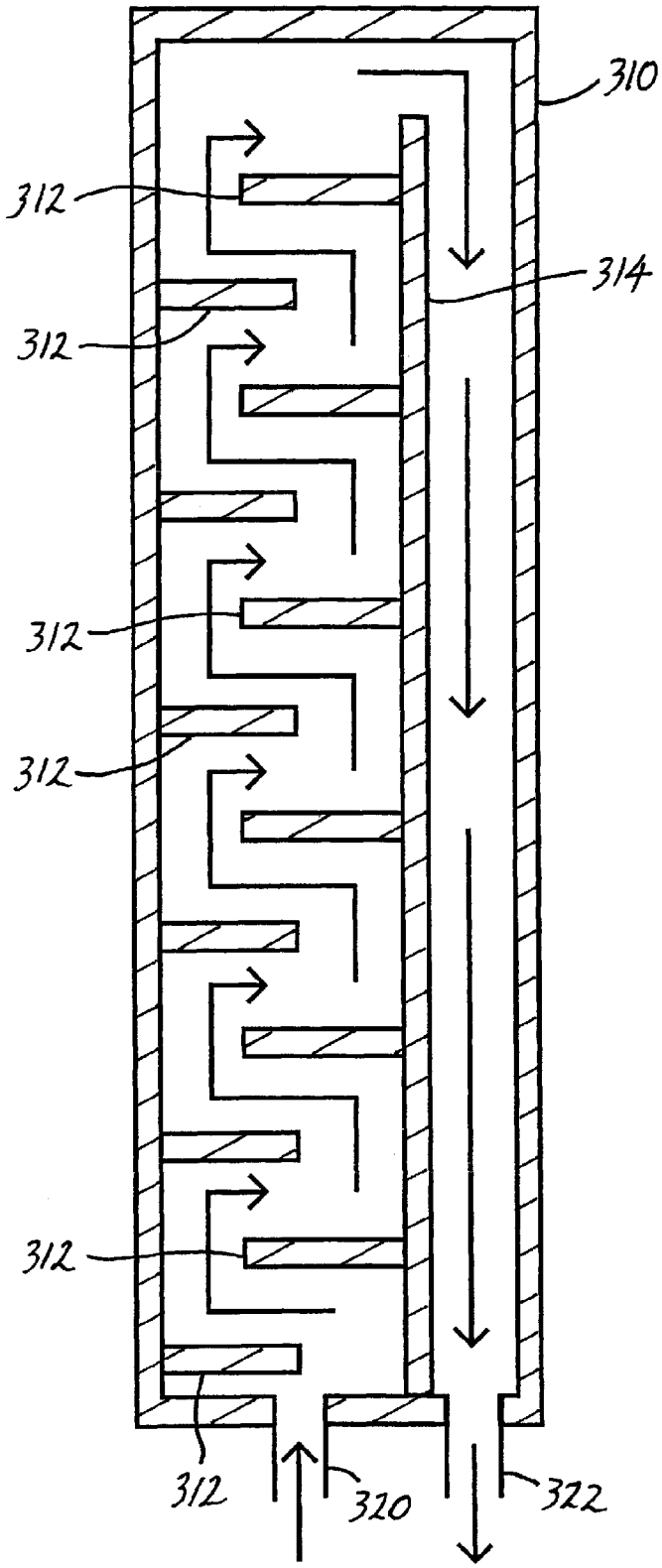
FIG. 7 is a cross sectional view of a water heating apparatus having a plurality of horizontally and vertically oriented heating members.

FIG. 7 is a water heating apparatus 310 of a configuration containing horizontal heating members 312 and vertical heating member 314 forming a winding water path. Similarly, cold water enters the heating apparatus 310 through the water inlet 320. The cold water is heated by the horizontal and vertical heating members 312, 314 as it moves along the path indicated by the arrows. Heated water exits the heating apparatus 310 through the water outlet 322.

Figure 8:
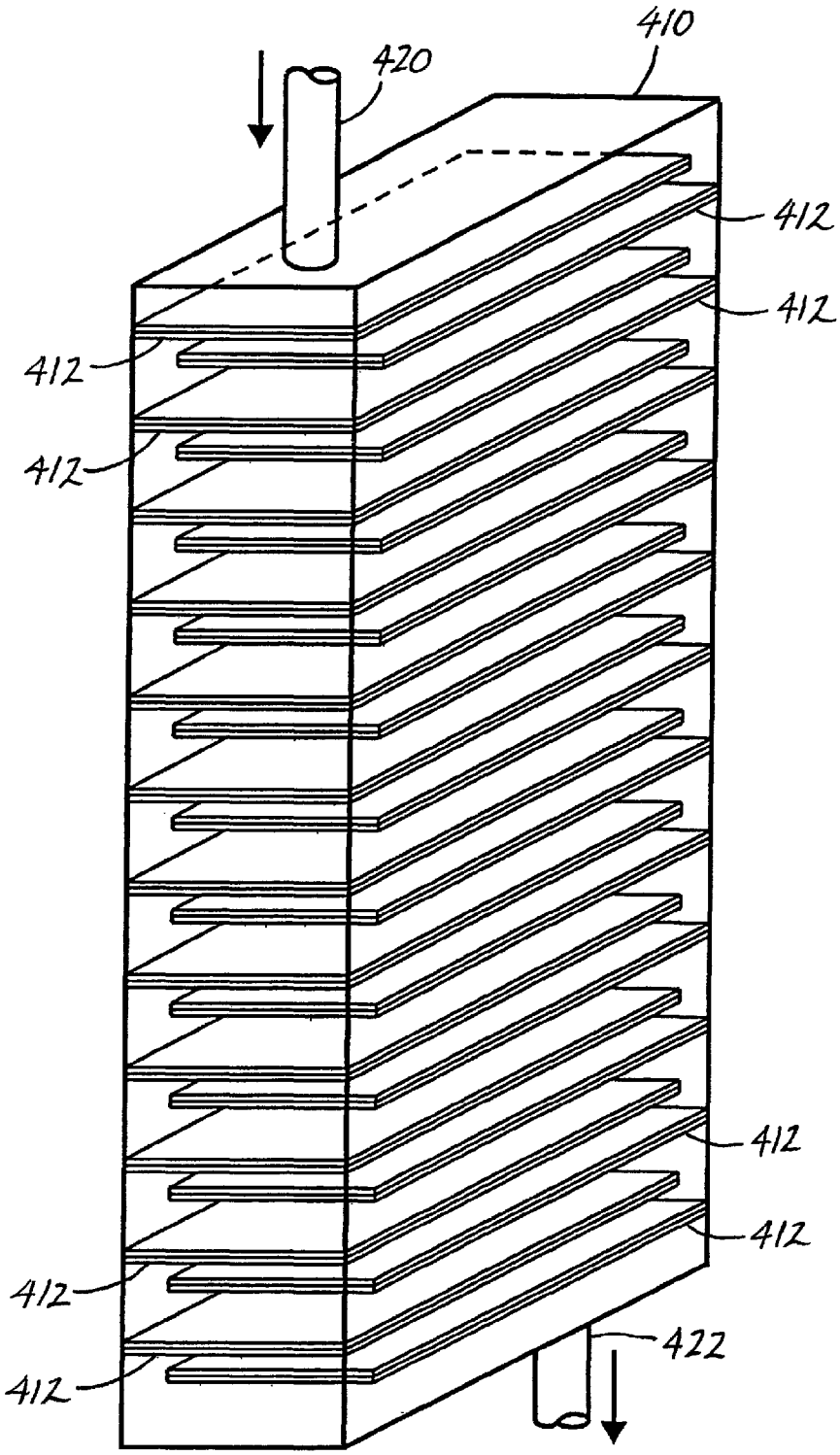
FIG. 8 is an illustrative diagram of a first embodiment of a high capacity water heating apparatus.
Figure 9:
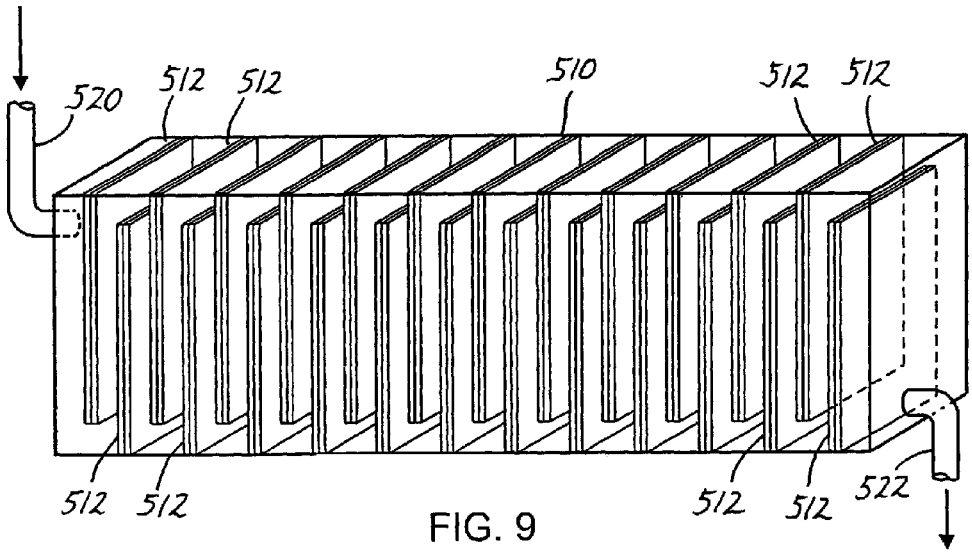
FIG. 9 is an illustrative diagram of a second embodiment of a high capacity water heating apparatus.

FIGS. 8 and 9 are high capacity water heating apparatus 410, 510 for industrial applications. In these water heating apparatus 410, 510, the heating members 412, 512 can be connected to a separate electric power supply. Alternatively, the heating members 412, 512 can be electrically connected to one another in parallel or in series to a single phase or a three-phase electric power supply.

In FIGS. 5-9, power output or energy consumption of the water heating apparatus 110, 210, 310, 410, 510 can be increased or decreased by increasing or reducing the number of heating members 112, 212, 312, 412, 512, respectively. To achieve this, simply add more heating members to the water heating apparatus, or remove some of the heating members from the water heating apparatus, or disconnecting the power supply to some of the heating members. In practical uses, the water heating apparatus can be configured with a small number of heating members of a large heating area or a larger number of heating members with smaller heating area, depending upon the requirements for heating output.

The heating apparatus 110, 210, 310, 410, 510 can also increase or decrease its power output or energy consumption by increasing or reducing the power capacity of each individual heating member 112, 212, 312, 412, 512, respectively. The power capacity of each heating member can be improved by the increase of the conductivity of the conductive coatings 16, 16' through changing their compositions, coating areas, process conditions and connections. Using split coating areas and electrode connections, high wattage density power output over small area can be achieved with a.c. power supply. Heating members with high wattage density can be developed. Improvement of electrical conductivity of a heating member and its power output can be achieved by arranging the conductive coatings 16, 16' in a parallel connection configuration. For example, a heating member contains five conductive coatings 16, 16', each can generate a power rating of about 1000 W using a.c. power. Each conductive coatings 16, 16' can be used individually or function together to generate a total power output of about 5000 W. These conductive coatings 16, 16' in a sealed laminate form are waterproof and can perform high efficiency water heating in electric kettles and hot water heaters, with capacity to outperform the conventional hot water heaters.

Figure 10A:
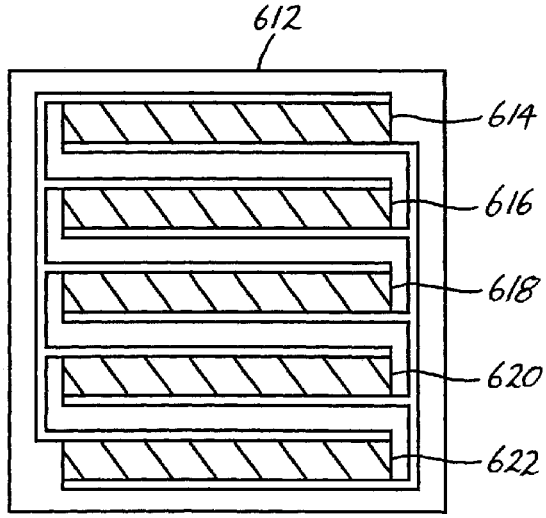
FIG. 10*a* is a heating member having five conductive coatings in a parallel connection.

FIG. 10*a* shows a parallel connection of five conductive coatings 614, 616, 618, 620, 622 in a heating member 612 that can reduce the electrical resistance of the heating member 612 to below 10 ohms. With an electrical resistance of 10 ohms, at an a.c. voltage of 220V, a power rating of 4840 W can be generated by a single heating member. With four of such heating members installed in a water heating apparatus, as the one shown in FIG. 6, a total power output of about 19 kW can be easily achieved.

Figure 10B:
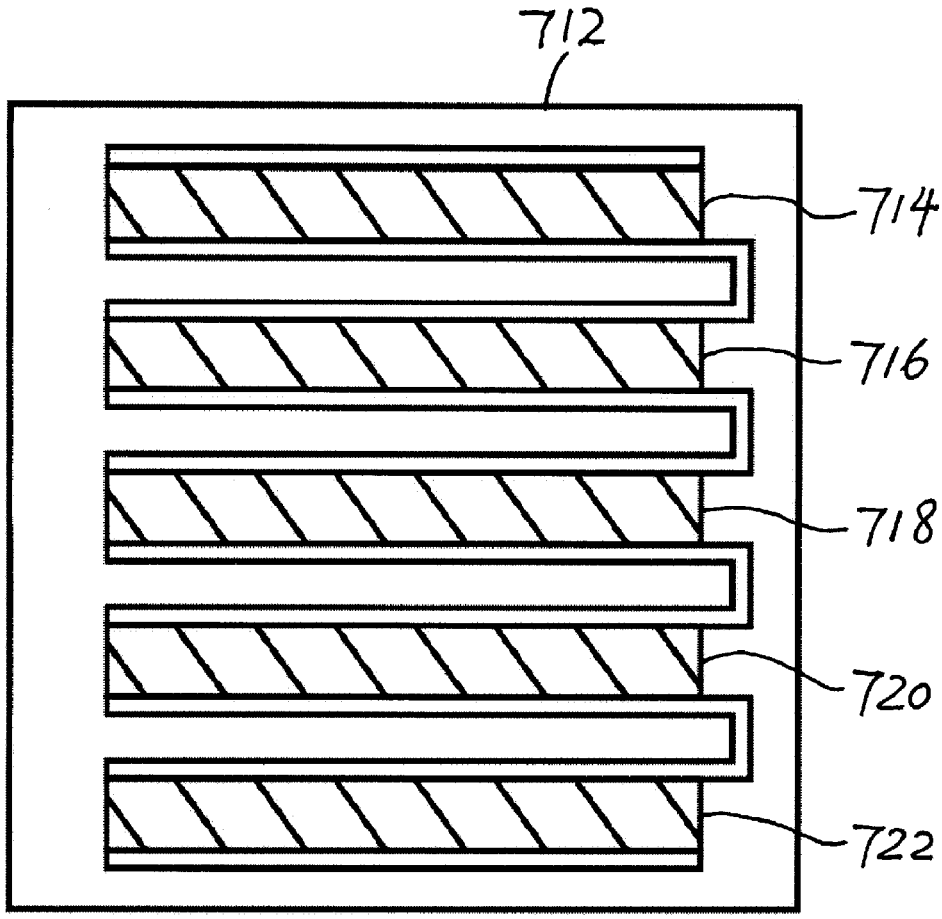
FIG. 10*b* is a heating member having five conductive coatings in a series connection.

The conductive coatings can also be connected in series. FIG. 10*b* shows a series connection of five conductive coatings 714, 716, 718, 720, 722 in a heating member 712. With each conductive coating of electrical resistance of 2 ohms, an electrical resistance of 10 ohms is achieved in the series connection of the five conductive coatings. At an a.c. voltage of 220V, a power rating of 4840 W can be generated by a single heating member. With four of such heating members installed in a water heating apparatus, as the one shown in FIG. 6, a total power output of about 19 kW can also be achieved.

Figure 11:
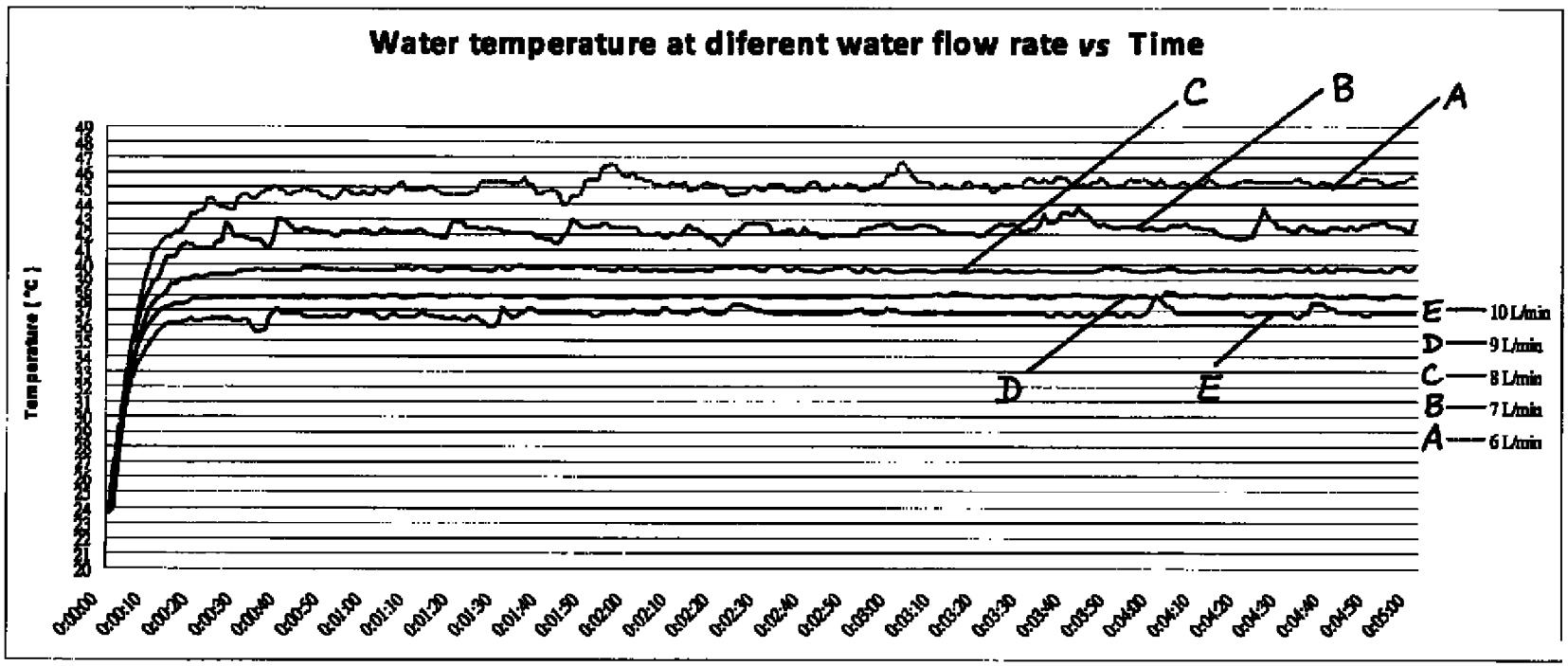
FIG. 11 is a plot of increase of water temperature at a total power output of about 9 kW from three heating members, each of power output of about 3 kW.
Figure 12:
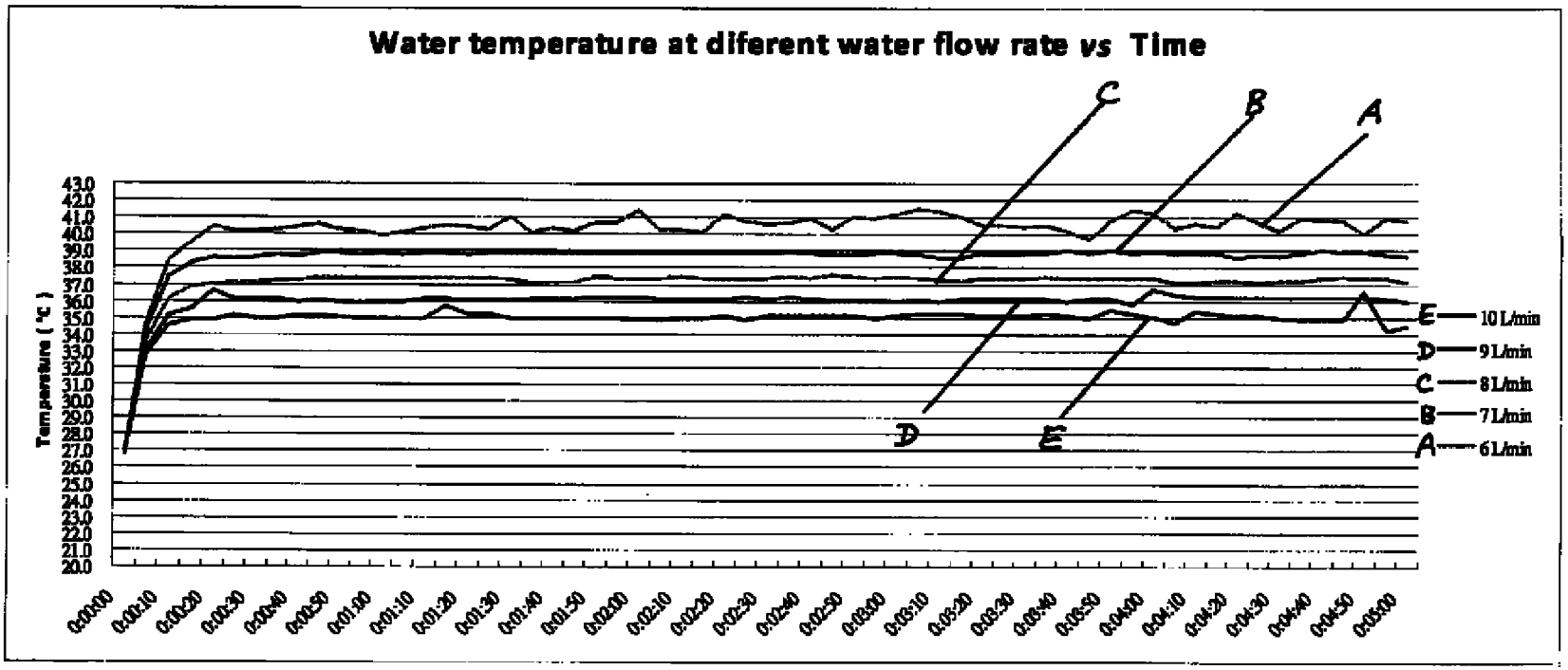
FIG. 12 is a plot of increase of water temperature at a total power output of about 6 kW with two heating members, each of power output of about 3 kW.

With the ceramic glass heating members of this application, fast instant water heating in the apparatus can be achieved. FIGS. 11 and 12 show the rise of water temperature at different water flow rates and power ratings. FIG. 11 is a plot of the results generated from a total power output of about 9 kW with three heating members, each of power output of about 3 kW. FIG. 12 is a plot of the results from a total power output of about 6 kW with two heating members, each of power output of about 3 kW. It is demonstrated that with a 3-phase power output of about 9 kW, a temperature rise of about 20° C. can be achieved within about 20 seconds at a water flow rate of 6 litres per minute. A steady water temperature at 44° C. can be achieved thereafter. The rise of water temperature was affected by the water flow rate. At a higher water flow rate of 10 litres per minute, water temperature rise is about 12° C. in 20 seconds, and then the water temperature becomes steady at 36° C. With two single phase heating members of a total of about 6 kW power output, some change on the heating performance can be observed. At a water flow rate of 6 litres per minute, a rise of water temperature of 13° C. can be achieved in 20 seconds and water temperature can be steady at about 40° C. At a water flow rate of 10 litres per minute, water temperature rise is about 8° C. in 20 seconds and water temperature is steady at 35° C. For most popular brand hot water heaters currently available in the commercial market, with a single phase power of 6 kW, a water temperature of 40° C. can be achieved at a much lower water flow rate of 3 litres per minute for kitchen uses. In general a minimum water flow rate of 5 litres per minute is required for bath showers.

The power monitor and control system 14 using ADC (analog-to-digital converter) and PWM (pulse-width modulation) drives can be integrated with the conductive coatings in smoothing the power supply to the heating members, in accordance with the flow rate and temperature of water and optimizing the heating performance and energy saving efficiency of the heating members.

Figure 13:
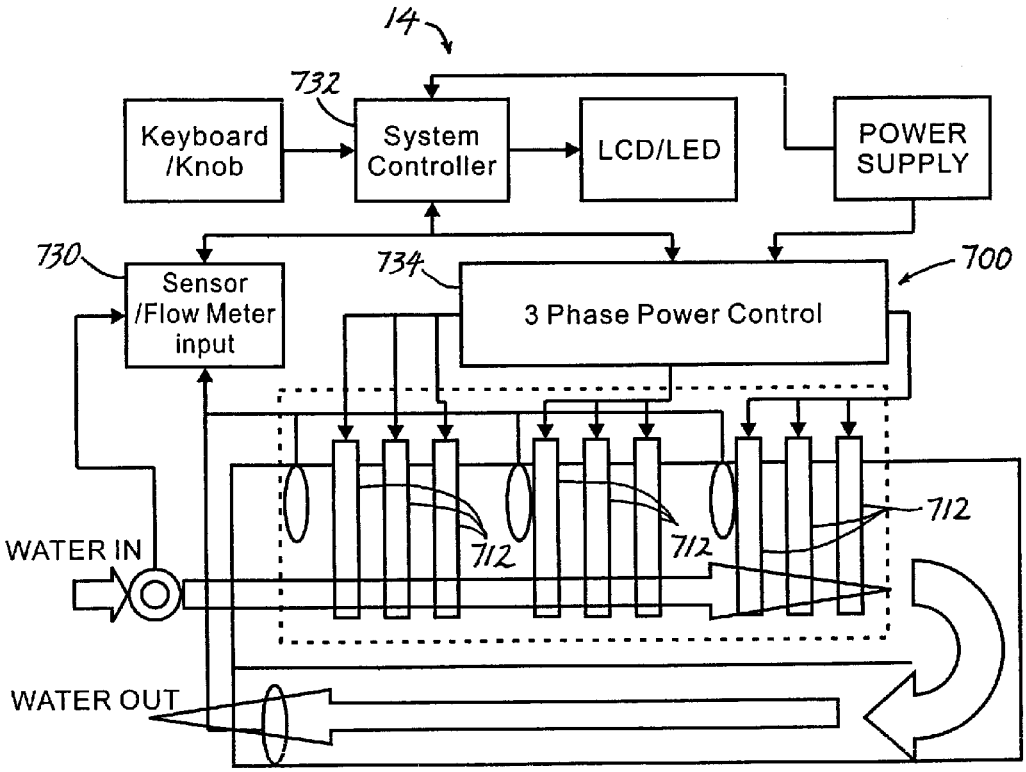
FIG. 13 is a block diagram of a 3-phase a.c. powered water heater system consisting of nine heating members.
Figure 14:
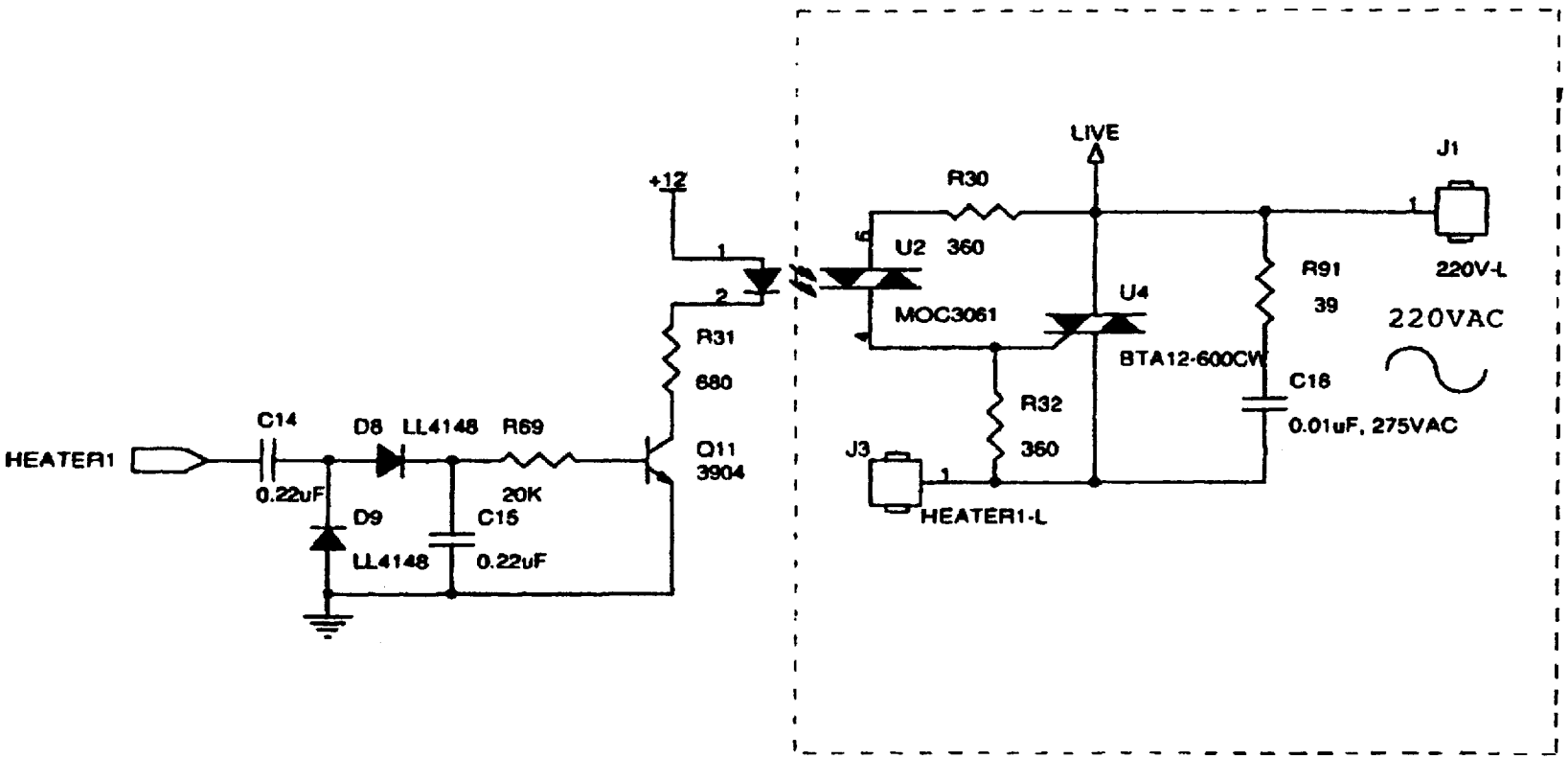
FIG. 14 is a circuitry diagram of a monitoring connection to power supply.
Figure 15:
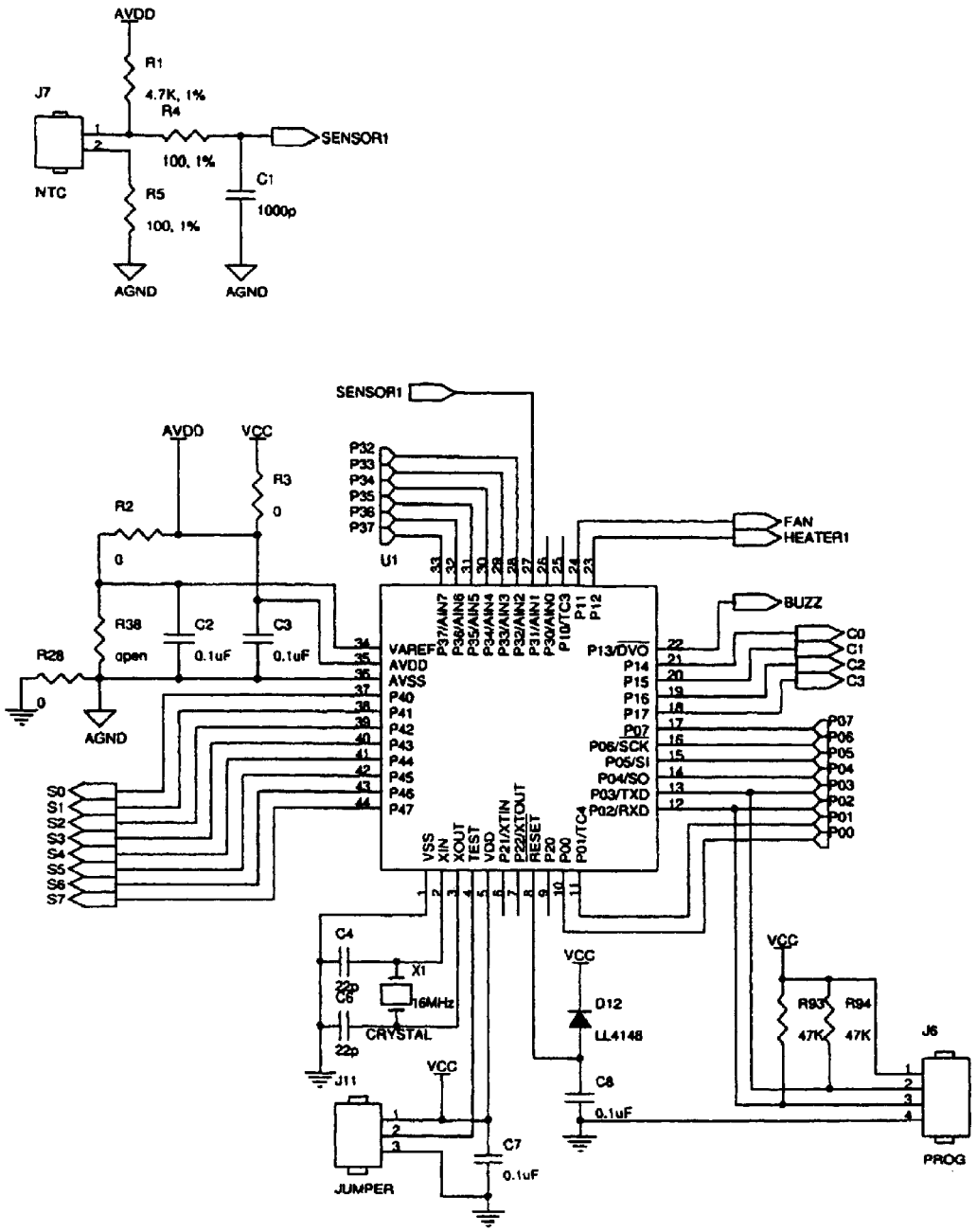
FIG. 15 is a circuitry diagram of the ADC and PWM drives of a power monitor and control system.

FIG. 13 is a block diagram of a 3-phase a.c. powered water heater system 700 consisting of nine heating members 712. Temperature sensor and flow meter 730 may be integrated with the system controller 732 of the power control 734 in accordance with preset conditions of water temperature and water flow rate in use. In particular, the power monitor and control system 14 using ADC and PWM drives may be integrated with the nano-thickness heating films in smoothing the power supply to the heating members and optimizing their heating performance and energy saving efficiency. The power monitor and control system 14 may be integrated with the conductive coatings for optimum temperature and energy saving control. Driving software and controller using ADC for temperature measurement and PWM for precise power control may be integrated with the heating members with the circuitry as shown in FIGS. 14 and 15. With this monitor and control system 14, a kind of heating servo system can be developed to match with and optimize the fast and efficient heating characteristics of the conductive coatings of nano-thickness in achieving fast heating up time (within 1 minute), accurate temperature target (+/−2° C.) and maximum energy savings (of efficiency up to 95%). When the water reaches the preset target temperature, the ADC and PWM control system will immediately respond and cut off power supply for energy saving purpose and restricting offshoot of the conductive coating temperature. When the water temperature falls below the preset temperature, ADC and PWM will then respond and switch on power supply for heat generation. The servo system therefore can provide continuous monitoring and controlling with fast responses in smoothing the power supply to the heating members and optimizing their heating performance and energy saving efficiency.

While the water heating apparatus disclosed in the present application has been shown and described with particular references to a number of preferred embodiments thereof, it should be noted that various other changes or modifications may be made without departing from the scope of the appending claims.

What is claimed is:

1. A water heating apparatus comprising:

a water tank;

at least one a plurality of heating members mounted inside the water tank, the heating member comprising:

a heating body;

at least a multi-layer conductive coating of about 50 nm to about 70 nm each layer in thickness deposited on the heating body; and electrodes coupled to the multi-layer conductive coating;

wherein the plurality of heating members arranged horizontally and vertically forming a winding water path in the water tank.

2. The water heating apparatus as claimed in claim 1, wherein the plurality of heating members electrically connected to one another in series.

3. The water heating apparatus as claimed in claim 1, wherein the plurality of heating members electrically connected to one another in parallel.

4. The water heating apparatus as claimed in claim 1, wherein the heating body of the heating member is in the form of a flat plate.

5. The water heating apparatus as claimed in claim 1, wherein the heating body of the heating member is made of ceramic glass.

6. The water heating apparatus as claimed in claim 1, wherein the electrodes comprise ceramic frit.

7. The water heating apparatus as claimed in claim 1, wherein the heating member comprises a plurality of conductive coatings electrically connected to one another in series.

8. The water heating apparatus as claimed in claim 1, wherein the heating member comprises a plurality of conductive coatings electrically connected to one another in parallel.

9. The water heating apparatus as claimed in claim 1, further comprising a power monitor and control system having analog-to-digital converter and pulse-width modulation drives.

10. The water heating apparatus as claimed in claim 1, wherein the heating member is removably mounted inside the water tank.

11. The water heating apparatus as claimed in claim 1, wherein the heating element comprises one or more layers of insulating material.

12. The water heating apparatus as claimed in claim 11, wherein each layer of the insulating material is about 30 to about 50 nm in thickness.

* * * * *